US007197973B2

(12) United States Patent
Fleming et al.

(10) Patent No.: US 7,197,973 B2
(45) Date of Patent: Apr. 3, 2007

(54) LOCKING ASSEMBLY FOR FIREARM SIMULATORS

(75) Inventors: Paul Heath Fleming, Sugarhill, GA (US); Henry Martin Wilson, Jr., Buford, GA (US)

(73) Assignee: Fats, Inc., Suwanee, GA (US)

( * ) Notice: Subject to any disclaimer, the term of this patent is extended or adjusted under 35 U.S.C. 154(b) by 0 days.

(21) Appl. No.: 11/167,536

(22) Filed: Jun. 27, 2005

(65) Prior Publication Data

US 2006/0063136 A1 Mar. 23, 2006

Related U.S. Application Data

(62) Division of application No. 10/638,776, filed on Aug. 11, 2003, now Pat. No. 6,938,534.

(51) Int. Cl.
*F41A 3/38* (2006.01)
*F41A 33/06* (2006.01)

(52) U.S. Cl. ..... 89/190; 434/18

(58) Field of Classification Search ..... 89/138; 434/18

See application file for complete search history.

(56) References Cited

U.S. PATENT DOCUMENTS 2,512,027 A 6/1950 Lippert et al.
3,964,365 A 6/1976 Zielinski
4,194,304 A 3/1980 Wolcott
4,302,190 A 11/1981 Shaw et al.
4,362,145 A 12/1982 Stelcher
4,365,959 A 12/1982 Caurant et al.
4,380,437 A 4/1983 Yarborough, Jr.
4,480,999 A 11/1984 Witherell et al.
4,678,437 A 7/1987 Scott et al.
5,383,442 A 1/1995 Tippmann
5,569,085 A 10/1996 Igarashi et al.
5,775,312 A 7/1998 Wilkinson et al.
5,791,328 A 8/1998 Alexander
5,947,738 A 9/1999 Muehle et al.
6,682,350 B2 * 1/2004 Kehl et al. ..... 434/18
2005/0074726 A1 * 4/2005 Metcalfe et al. ..... 434/18

* cited by examiner

*Primary Examiner*—Troy Chambers
(74) *Attorney, Agent, or Firm*—Smith, Gambrell & Russell, LLP

(57) ABSTRACT

A bolt locking assembly for a weapon simulator, the weapon simulator having a bolt affixed to a firearm housing providing recoil to the user. The bolt is connected to a piston housed in a piston chamber inside the housing. A gas supply provides a compressed gas or fluid into the piston chamber to generate movement and recoil of the piston. After the weapon simulator has been fired a predetermined number of times, the bolt locking assembly will obstruct operation of the bolt and piston. The bolt locking assembly includes a lock actuator port engaging the piston chamber, a locking apparatus positioned within the housing proximate the bolt, and a lock channel between said lock actuator port and said locking arm, wherein the lock channel directs gas to said locking apparatus to actuate said locking apparatus and fix the bolt in place.

7 Claims, 2 Drawing Sheets

LOCKING ASSEMBLY FOR FIREARM SIMULATORS

CROSS REFERENCE TO RELATED APPLICATIONS

This application is a divisional of U.S. patent application Ser. No. 10/638,776, filed on Aug. 11, 2003, which issued on Sep. 6, 2005 as U.S. No. 6,938,534, and which is herein incorporated by reference.

BACKGROUND OF THE INVENTION

1. Field of the Invention

The present invention relates to firearms and firearm simulators and, more particularly, to a means for locking a bolt of a firearm simulator.

2. Description of the Prior Art

Because of the lethal characteristics inherent in operating guns, proper training in their use is imperative. Such training often involves the firing of blanks or live ammunition. Load noise, spent cartridge waste, noxious burned powder odors, repetitive reloading, environmental constraints, high cost and overall danger are all substantial detriments to the use of blanks or live ammunition.

To overcome the above disadvantages, training devices have evolved for simulating the firing of guns. These devices relate to weaponry having primarily military use. U.S. Pat. No. 4,302,190 discloses a rifle recoil simulator whereby compressed air passes through orifices in the rifle barrel to force the barrel upward in a recoil motion. A trigger switch activates an electronic timer-solenoid-air valve system for controlling air passage to the barrel orifices.

Artillery loading and recoil simulators are described in U.S. Pat. Nos. 4,194,304 and 4,365,959. These are complex mechanisms designed to train entire gunnery crews. They are not directly related to locking assemblies, which is the subject of the present invention.

To improve the realism of the weapons familiarization process and to provide a more "lifelike" experience, a variety of approaches have been suggested to make the weapons range more realistic. For example, some weapons ranges provide paper targets with threatening images rather than bull's-eye targets. In attempts to present a more realistic scenario to the participant and to provide an interactive and immersive experience, some weapons ranges have replaced such fixed targets with moving or "pop-up" targets such as spring-loaded mechanical images or animated video images projected onto a display screen. The pop-up or animated images present moving targets and/or simulated return threats toward which the participant fires. One problem with such an approach is that the bullets damage or destroy the target. For example, the bullets can punch holes through display screens, eventually rendering the screens inoperative. Further, use of live ammunition can be very dangerous, especially in unfamiliar training exercises where the participant's performance limits are tested.

To address such problems, some training ranges use non-lethal ammunition, such as projectiles propelled by air cartridges in place of conventional bullets. One type of non-lethal ammunition is a Crown Type E air cartridge. In conventional uses of such cartridges, a releasable cap attaches to the cartridge and covers an outlet port. Then, when the outlet port is opened, a highly pressurized gas is released from the cartridge and propels the releasable cap away from the cartridge at a high velocity. The cap travels through a gun barrel and is emitted from the gun as a non-lethal projectile. To detect the impact locations of the non-lethal projectile, some such ranges use some type of projectile tracking device, such as high-speed imaging equipment. Such ranges can be very expensive due to their complexity and use of specialized equipment.

Other ranges allow the non-lethal ammunition to penetrate or otherwise mark a target object to indicate impact location. Such ranges have the drawback that the non-lethal ammunition is destructive. Additionally, the impact locations are difficult to track on a "real-time" basis, which makes interactive ranges difficult. Also, while such approaches may improve visual approximations of actual situations as compared to paper targets, such approaches lack a visual or other virtually instantaneous feedback indicating the effectiveness of the participant's fire.

Another alternative type of weapons range employs a light beam in place of a projectile. In such ranges, the participant holds a simulated weapon shaped like a conventional weapon that is activated by a switch coupled to a conventionally shaped and positioned trigger. When the participant pulls the trigger, the simulated weapon emits a light beam that strikes the target, causing an illuminated spot. An optical detector detects the spot and indicates the impact location.

Such simulated weapons lack a realistic feel because they do not recoil in response to the simulated fire. Moreover, the simulated weapons do not emit shells that can distract the participant and can affect the participant's footing.

To try to simulate an actual weapon's recoil, a compressed air line can be coupled to the simulated weapon. Then, when the trigger is pulled, an air driven mechanism applies a pulse of force to the simulated weapon to produce a simulated recoil. Such a system has the drawback that the air line acts as a tether, limiting the participant's mobility and affecting aim. The system also lacks the ejected shells of actual or non-lethal ammunition.

The prior art attempts, including those described in U.S. Pat. Nos. 5,947,738 5,569,085, 4,480,999, and 4,678,437, to simulate recoil have limitations and drawbacks as discussed above in addition to being tethered to a console, lack of proper feel and balance, and related problems, all of which are solved by the present invention.

More particularly, in order to simulate a locked, out-of-ammunition situation, the weapon simulators have utilized a dedicated slide/bolt lock valve to control the slide or bolt lock mechanism. That is, during a normal firing cycle, only the recoil valve is energized to actuate the recoil cycle. However, during the final firing cycle, both the recoil valve and slide/bolt lock valves are actuated, such that the slide/bolt lock valve will lock the bolt of the weapon simulator to temporarily prevent further operation of the weapon simulator.

BRIEF SUMMARY OF THE INVENTION

The present invention is a bolt locking assembly for a weapon simulator. The weapon simulator includes a bolt affixed to a firearm housing providing recoil to the user. The bolt is connected to a piston housed in a piston chamber inside the housing. A gas supply provides a compressed gas or fluid into the piston chamber to generate movement and recoil of the piston. After the weapon simulator has been fired a predetermined number of times, the bolt locking assembly will block operation of the bolt and piston.

The bolt locking assembly includes a lock actuator port engaging the piston chamber, a locking apparatus positioned within the housing proximate the bolt, and a lock channel between said lock actuator port and said locking arm, wherein the lock channel directs gas to said locking apparatus to actuate said locking apparatus and fix the bolt in place.

BRIEF DESCRIPTION OF THE DRAWINGS

An apparatus embodying features of the claimed invention are depicted in the accompanying drawing which form a portion of this disclosure and wherein:

DESCRIPTION OF THE PREFERRED EMBODIMENT

Figure 1:
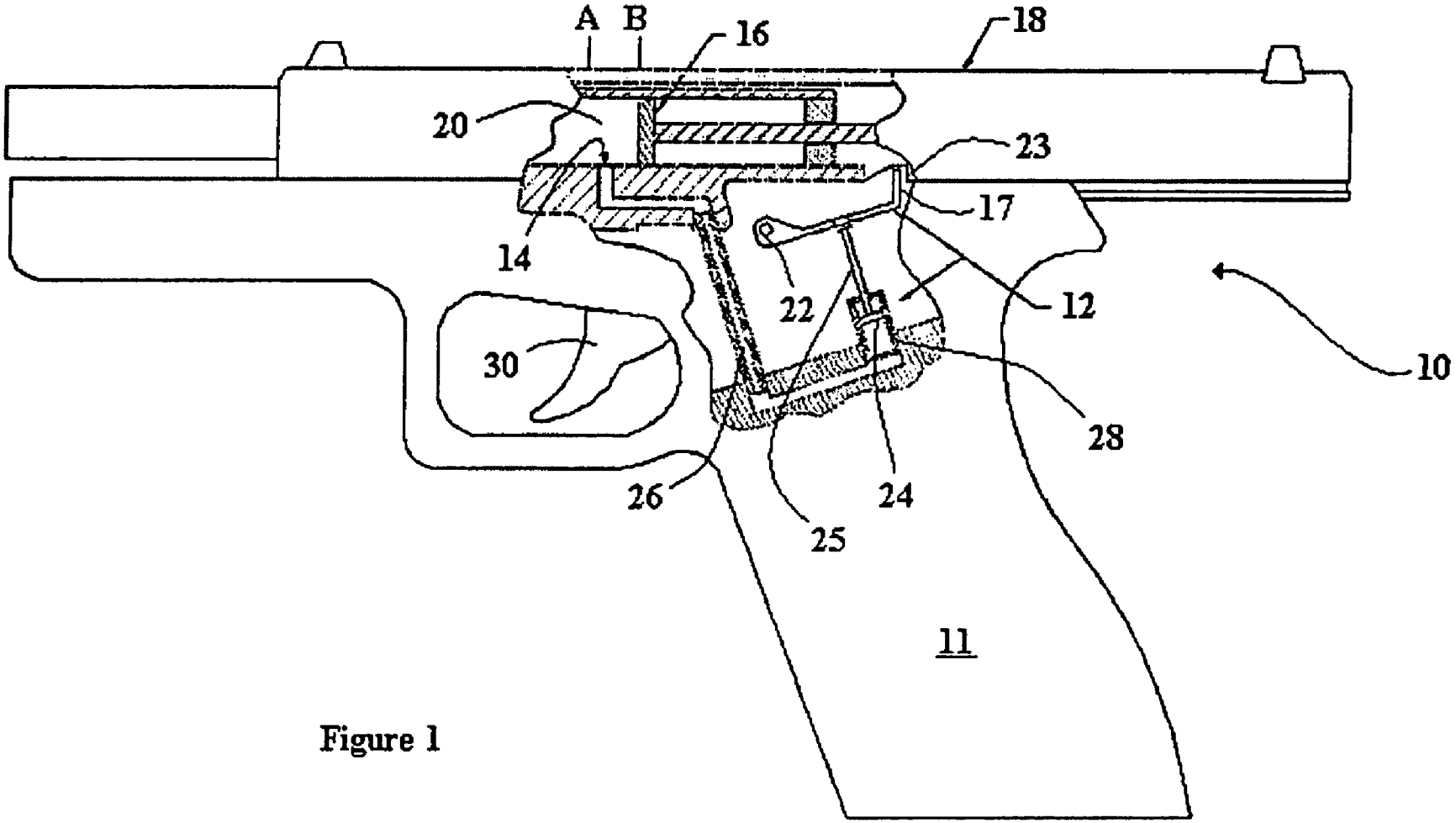
FIG. 1 is a partial sectional side view of the weapon simulator having a bolt locking assembly of the present invention.
Figure 2:
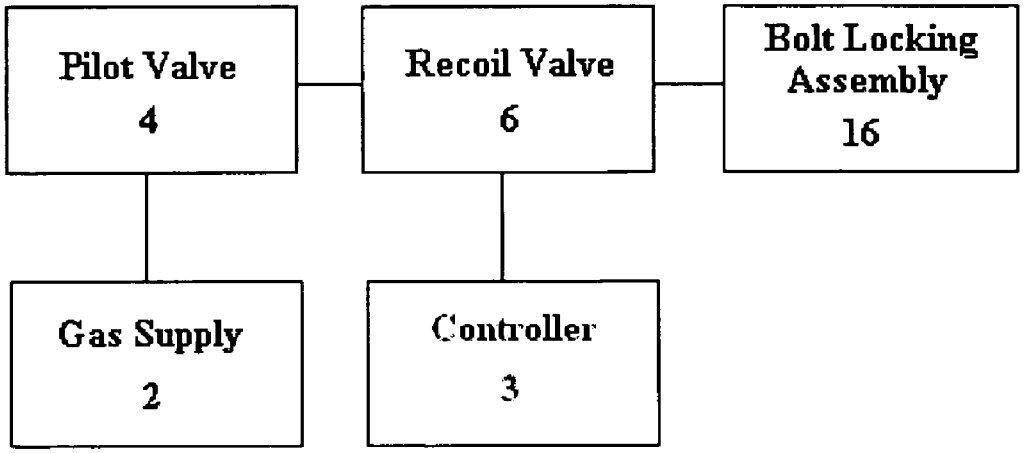
FIG. 2 is a block diagram of the distribution of a gas or liquid from a gas supply to the bolt locking assembly of the present invention.

Referring to FIGS. 1 and 2, the present invention of a bolt locking assembly 12 for a firearm or weapon simulator 10 is illustrated. As shown, the weapon simulator 10 incorporates a housing or frame 11 surrounding a regulated gas supply 2 and including a pilot valve 4 and a recoil valve 6 to cycle the weapon simulator 10 and actuate a slide or bolt 18 affixed to the housing 11 upon the firing of the weapon simulator 10 by a user. The action of the bolt 18 is sufficient to generate substantial recoil for the user to imitate the actual use of a conventional firearm. Specifically, the weapon simulator 10 includes a piston 16 that is housed within a piston chamber 20, with the piston 16 being connected through the housing 11 to the bolt 18 of the weapon simulator 10. When fired, the gas supply 2 will provide a gas flow within the piston chamber 20 to create a forceful movement of the piston 16 within the piston chamber 20. This movement of the piston 16 will simultaneously generate movement of the bolt 18 to create recoil.

The bolt locking assembly 12 of the present invention is used in conjunction with the weapon simulator 10 to provide a simple means for locking the bolt 18 using the gas supply 2 directed to creating recoil in the weapon simulator 10. That is, the weapon simulator 10 includes the bolt locking assembly 12 that is controlled by the same pilot valve 4 and gas supply 2 that controls the recoil operation of the bolt 18 of the weapon simulator 10. As a result, the need for a separate slide/bolt lock valve as required in other weapon simulator designs described above is eliminated, thus further reducing the number of components needed for realistic operation of the weapon simulator 10.

The bolt locking assembly 12 includes a lock actuator port 14 that is connected to a locking assembly via a lock channel 26. The locking assembly 12 preferably includes a locking arm 17 that is pivotally mounted within the housing 11 on a pivot pin 22 and means for actuating the locking arm 17. The actuating means of the present invention include an actuating arm 25, an actuating plate 24, and a plate chamber 28, although it is foreseen that other actuating designs may be incorporated. Continuing to view FIG. 1, the actuating arm 25 is connected to the locking arm 17, with the actuating plate 24 attached to the opposite end of the locking arm 17. The actuating plate 24 is slidably mounted within a plate chamber 28 that is connected via lock channel 26 to a lock actuator port 14. The lock actuator port 14 is further opens to the piston chamber 20.

In operation, the user engages a switch 30, such as a conventional firearm trigger, to prompt the firing of the weapon simulator 10. A recoil valve 6 allows a compressed gas or fluid to flow inside the piston chamber 20 to force the bolt 18 toward the user of the weapon simulator 10, thereby generating recoil by the weapon simulator 10. In such cases, the piston 16 will generally travel in the piston chamber 20 to position A.

A sensor, controller or other related component 3 will monitor the number of times the weapon simulator 10 is fired. Once the weapon simulator 10 has been fired a predetermined number of times, the bolt locking assembly 12 will be set in operation. In particular, the recoil valve 6 will remain open for a preset amount of time, such that the compressed gas or fluid from the gas supply 2 will force the piston 16 to travel in the piston chamber 20 to position B, past the bolt lock actuator port 14. Once the piston 16 is beyond the lock actuator port 14, the gas applying a force on the piston 16 will flow from the piston chamber 20 through the lock actuator port 14 and lock channel 26 into the plate chamber 28. Furthermore, the compressed gas will apply pressure to the actuating plate 24, thereby concomitantly driving the actuator arm 25. The actuator arm 25 will thereby pivot the locking arm 17 about the pivot pin 22 such the locking arm 17 will be proximate a shoulder 23 of the bolt 18. As the recoil valve 6 closes, the bolt 18 will be drawn back to the original resting position, and the shoulder 23 will engage the locking arm 17. Once the shoulder 23 of the bolt 18 engages the locking arm 17, the bolt 18 will be locked in place, wherein the locking arm 17 will prevent the bolt 18 from returning to its original resting position with respect to the housing 11.

The bolt 18 will remain in the locked position until the user takes action to unlock the bolt 18. While the bolt 18 is locked, the firearm simulator 10 will be inoperable, as with an actual firearm. However, once the user either resets the bolt 18 or takes some additional action, the weapon simulator 10 will be operable once again.

Thus, although there have been described particular embodiments of the present invention of a new and useful LOCKING ASSEMBLY FOR FIREARM SIMULATORS, it is not intended that such references be construed as limitations upon the scope of this invention except as set forth in the following claims.

What is claimed is:

1. A bolt locking assembly for use in a weapon simulator, the weapon simulator having a bolt affixed to a housing, the housing defining a piston chamber surrounding a piston, and a gas supply forcing gas into the piston chamber to generate movement of the piston to simulate recoil of a firearm, wherein said bolt locking assembly comprises:

a lock actuator port in the piston chamber;

a locking apparatus positioned within the housing proximate the bolt; and a channel connecting said lock actuator port with said locking apparatus and directing gas from the piston chamber to said locking apparatus.

2. The bolt locking assembly as described in claim 1, wherein said locking apparatus includes:

a locking arm; and actuating means for moving said locking arm, said actuating means connected to said locking arm.

3. The bolt locking assembly as described in claim 2, wherein said actuating means comprises:

an actuating arm connected to said locking arm;

an actuating plate attached to said actuating arm; and a plate chamber housing said actuating plate, said plate chamber joined with said channel to receive said compressed gas to shift said actuating plate.

4. A bolt locking assembly for use in a firearm simulator having a firearm frame and a slidable bolt affixed thereto, the firearm frame defining a piston chamber surrounding a piston, the piston being connected with the bolt, wherein the bolt locking assembly comprises:

a gas source in communication with the piston chamber, said gas source providing gas to the piston chamber to generate movement of the piston in the piston chamber;

a recoil valve positioned between said gas source and the piston chamber to control the distribution of gas into the piston chamber;

a lock actuator port in the piston chamber positioned proximate the piston to receive gas from said gas source according to the position of the piston; and a locking apparatus positioned within the housing proximate the bolt; and a lock channel between said lock actuator port and said locking apparatus to supply gas to said locking apparatus from said gas source.

5. The bolt locking assembly as described in claim 4, wherein said locking apparatus includes:

a locking arm; and actuating means for moving said locking arm, said actuating means connected to said locking arm.

6. The bolt locking assembly as described in claim 5, wherein said actuating means comprises:

an actuating arm connected to said locking arm;

an actuating plate attached to said actuating arm; and a plate chamber housing said actuating plate, said plate chamber joined with said lock channel to receive said compressed gas to shift said actuating plate.

7. A bolt locking assembly for use in a weapon simulator, the weapon simulator having a bolt affixed to a housing, the housing defining a piston chamber surrounding a piston, and a gas supply forcing gas into the piston chamber to generate movement of the piston to simulate recoil of a firearm, wherein said bolt locking assembly comprises:

a lock actuator port in the piston chamber;

a locking apparatus positioned within the housing proximate the bolt;

a lock channel connecting said lock actuator port with said locking apparatus and directing gas from the piston chamber to said locking apparatus;

a locking arm;

an actuating arm connected to said locking arm;

an actuating plate attached to said actuating arm; and a plate chamber housing said actuating plate, said plate chamber joined with said lock channel to receive said compressed gas to shift said actuating plate.

* * * * *